US012317991B2

(12) United States Patent
Williams

(10) Patent No.: US 12,317,991 B2
(45) Date of Patent: Jun. 3, 2025

(54) HOOK ARRANGEMENT FOR LOAD-CARRYING GARMENTS

(71) Applicant: SURVITEC GROUP LIMITED, London (GB)

(72) Inventor: Zachary James Williams, Hampshire (GB)

(73) Assignee: SURVITEC GROUP LIMITED, London (GB)

( * ) Notice: Subject to any disclaimer, the term of this patent is extended or adjusted under 35 U.S.C. 154(b) by 91 days.

(21) Appl. No.: 17/931,869

(22) Filed: Sep. 13, 2022

(65) Prior Publication Data

US 2023/0180859 A1 Jun. 15, 2023

(51) Int. Cl.
*A45F 5/02* (2006.01)

(52) U.S. Cl.
CPC ..... *A45F 5/02* (2013.01)

(58) Field of Classification Search
CPC ..... A45F 5/02; A45F 5/021; A45F 2003/001; A45F 2005/023; A45F 3/06; Y10T 24/3485; A45C 2013/306; A41D 13/0007; A41D 13/0012
USPC ..... 224/269, 666, 668
See application file for complete search history.

(56) References Cited

U.S. PATENT DOCUMENTS

| | | | | |
|---|---|---|---|---|
| 2,004,702 | A * | 6/1935 | Luttmann, Jr. | A43C 1/02 24/30.5 P |
| 3,509,581 | A * | 5/1970 | Lewis | A41F 11/02 450/111 |
| 8,079,503 | B1 | 12/2011 | Yeates et al. | |
| 8,523,029 | B2 * | 9/2013 | Rogers | F41C 33/045 224/675 |
| 8,590,121 | B1 * | 11/2013 | Patt, Jr. | A43B 3/0078 36/51 |
| 8,950,640 | B2 * | 2/2015 | Iannello | A45F 5/00 224/660 |
| D790,207 | S * | 6/2017 | Park | D2/978 |
| 10,420,415 | B1 | 9/2019 | Wallace | |
| 11,530,897 | B2 * | 12/2022 | Smith | F41C 33/041 |
| 2006/0113344 | A1 | 6/2006 | Cragg | |
| 2007/0158380 | A1 | 7/2007 | Calkin | |
| 2008/0086846 | A1 | 4/2008 | Wemmer | |
| 2008/0257922 | A1 | 10/2008 | Cragg | |
| 2021/0386184 | A1 | 12/2021 | Stanton | |

FOREIGN PATENT DOCUMENTS

| | | |
|---|---|---|
| GB | 2586860 A | 3/2021 |
| WO | 2006/116952 | 11/2006 |
| WO | 2013096110 A1 | 6/2013 |

OTHER PUBLICATIONS

European Patent Office; Extended European Search Report issued in EP Application No. 22193548 dated Jan. 26, 2023, 7 pages.
Search Report for GB Application No. GB2113030.7 mailed on Feb. 8, 2022.

* cited by examiner

*Primary Examiner* — Adam J Waggenspack
(74) *Attorney, Agent, or Firm* — MASCHOFF BRENNAN

(57) ABSTRACT

A hook arrangement for connecting to a load-carrying garment, comprising a main body portion from which two hook portions extend at opposite sides thereof, the hook portions each defining a recess for engaging the load-carrying garment in use.

8 Claims, 6 Drawing Sheets

HOOK ARRANGEMENT FOR LOAD-CARRYING GARMENTS

TECHNICAL FIELD

Disclosed embodiments relate to a hook arrangement for connecting to a load-carrying garment. Embodiments also relate to a load-carrying system including a load-carrying garment and a hook arrangement configured to be flexibly attached to a load. Additional embodiments relate to a method of attaching a load to a load-carrying garment.

BACKGROUND

For military use a load-carrying garment is known in the form of a vest or jacket that is formed with parallel spaced rows of webbing. The webbing is attached to the garment at spaced intervals so that each webbing has alternate attached and unattached sections along its length. The unattached sections are in vertical alignment. A load, for example a pouch, includes at least one flexible webbing strap that is attached at one end to the load and whose distal end is free. The load is also formed with parallel spaced rows of webbing. Each webbing is attached to the load at spaced intervals so that each webbing has alternate attached and unattached sections along its length. The unattached sections are in vertical alignment. The load is offered-up to the garment so that webbing rows on the load are between the webbing rows of the garment and the unattached sections are aligned. The distal end of the webbing strap is flexed and fed through an aligned row of unattached sections of the garment webbing and the load webbing and the webbing strap is long enough that the distal end can then be reversed back through the rows to draw the webbing through the row to secure the load to the garment.

Garments of this kind are disclosed in, for example, US2007/0158380, US2006/0113344, WO2006/116952 and US2008/0257922.

It is a problem with such garments that feeding the distal end of the load webbing through many rows of unattached sections is time consuming. In addition, the load has long lengths of webbing hanging from it before attachment and this can be inconvenient. There is also the possibility that the load webbings will pull free and, to try to prevent this, it has been proposed to provide the ends of the load webbings with press studs that fasten to the garment—but this increases cost and complexity. In addition, webbing rows are required on both the garment and the load.

SUMMARY

A first disclosed embodiment provides a hook arrangement for connecting to a load-carrying garment, comprising a main body portion from which two hook portions extend at opposite sides thereof, the hook portions each defining a recess for engaging the load-carrying garment in use.

The hook arrangement may be configured to co-operate with a Modular Lightweight Load-carrying Equipment (MOLLE) load-carrying garment comprising at least one row of webbing that is attached to a backing at attachment sections spaced at predetermined intervals, wherein the width of the hook arrangement from the distal edges of the oppositely extending hook portions is greater than the predetermined interval and the main body portion has a width less than or equal to the predetermined interval, the arrangement being such that the attachment sections fit into the recesses to engage the load-carrying garment in use. In one example, the main body portion may have a height less than or equal to 38 mm.

The main body portion may include a slot for receiving a strap or loop that is connected to a load for attachment to the load-carrying garment.

The hook arrangement may be formed from a sheet of rigid material, such as metal or plastics.

In another embodiment a load-carrying system includes:

- a garment formed with generally parallel spaced rows of webbing, each webbing being attached to the garment at spaced intervals so that each webbing has alternate attached and unattached sections along its length with the unattached sections in generally vertical alignment, and
- a hook arrangement configured to be flexibly attached to a load, wherein the hook arrangement comprises a main body portion from which two hook portions extend at opposite sides thereof, the hook portions each defining a recess for engaging the attached sections of the webbing in use, the hook arrangement being rotatable between a generally horizontal orientation, where due to its dimensions it cannot pass through the interval between said two adjacent attached sections of the webbing, and a generally vertical orientation, where due to its dimensions it can pass through the interval between said two adjacent attached sections of the webbing.

The hook arrangement may have a width from the distal edges of the oppositely extending hook portions that is greater than the interval between two adjacent attached sections of the webbing and a height that is less than or equal to the interval between said two adjacent attached sections of the webbing.

In one embodiment, the load-carrying system arrangement is such that the hook arrangement may pass through the interval between said two adjacent attached sections of the webbing in the generally vertical orientation whereafter the hook arrangement may be moved to the generally horizontal configuration so that the said two adjacent attached sections of the webbing fit into the recesses to engage the load-carrying garment in use.

The garment may comprise body armour.

The load may be a life preserver unit such as a lifejacket. The load may be any item that can usefully be carried by the wearer, such as pockets, holsters (e.g. for a weapon), communication equipment and first aid supplies.

The configuration of the hook arrangement may be such that a further load may be attached to the same portion of webbing between the adjacent attached sections of the webbing while the hook arrangement is in place.

Yet another embodiment provides a method of attaching a load to a load-carrying garment, wherein:

- the load-carrying garment is formed with generally parallel spaced rows of webbing, each webbing being attached to the garment at spaced intervals so that each webbing has alternate attached and unattached sections along its length with the unattached sections in generally vertical alignment,
- a hook arrangement is flexibly attached to the load, wherein the hook arrangement comprises a main body portion from which two hook portions extend at opposite sides thereof, the hook portions each defining a recess for engaging the attached sections of the webbing, and
- the method includes passing the hook arrangement in a generally vertical orientation through the interval between said two adjacent attached sections of the webbing, and moving the hook arrangement to a generally horizontal orientation so that the said two adjacent attached sections of the webbing fit into the recesses to engage the load-carrying garment.

The method may include attaching a further load to a portion of the webbing prior to attaching the said load to the same portion of webbing, the hook arrangement being passed behind a part attaching the further load to the portion of the webbing. Alternatively, the further load may be attached after the said load is attached.

The hook arrangement may be generally planar and extend generally parallel to the adjacent surface of the load-carrying garment and/or the adjacent surface of the webbing.

The hook arrangement may be used for securing lifejackets to body armor.

The hook arrangement can pass behind existing loads, pockets, and the like that have been attached to the load-carrying garment, occupying the same portion of webbing without interference.

The hook arrangement may be such that two adjacent attached sections of the webbing fit into the hook recesses to engage the load-carrying garment. This may mean there is no or little slack in the security of the hook arrangement, which could otherwise come over time as the load-carrying garment ages.

A securing loop or strap that attaches the hook arrangement to the load may have a thinner part that finally reaches the hook arrangement, and this may allow a wearer to turn the hook arrangement and allow it pass behind loads that are already in place without removing the existing loads to attach the additional load. Thus, the wearer does not have to reconfigure their equipment just to attach the additional load.

The hook arrangement may allow the load to sit flush to the load-carrying garment so there is no or a reduced snagging hazard.

Disclosed embodiments may allow a user to feed the hook arrangement onto the load-carrying garment (e.g. body armour) without interfering with an existing current set up of other loads mounted on the same garment.

The hook arrangement may anchor its associated load (e.g. a bladder of a lifejacket or other life preserver unit) into an optimal position to enhance the performance of the load/lifejacket. Anchoring a lifejacket on the correct position on the user's body is important to getting the performance from the bladder, embodiments may allow the lifejacket to anchor into place onto the load-carrying garment without affecting the set up of other loads on the body armour.

The load may be fixed at the front and the back of the load-carrying garment with hook arrangements which run through the webbing of the load-carrying garment at the front and the back.

BRIEF DESCRIPTION OF THE DRAWINGS

For a better understanding of the present invention, example embodiments will now be described with reference to the accompanying drawings, in which.

In the drawings, like elements are generally designated with the same reference sign.

DETAILED DESCRIPTION OF EXAMPLE EMBODIMENTS

Figure 1:
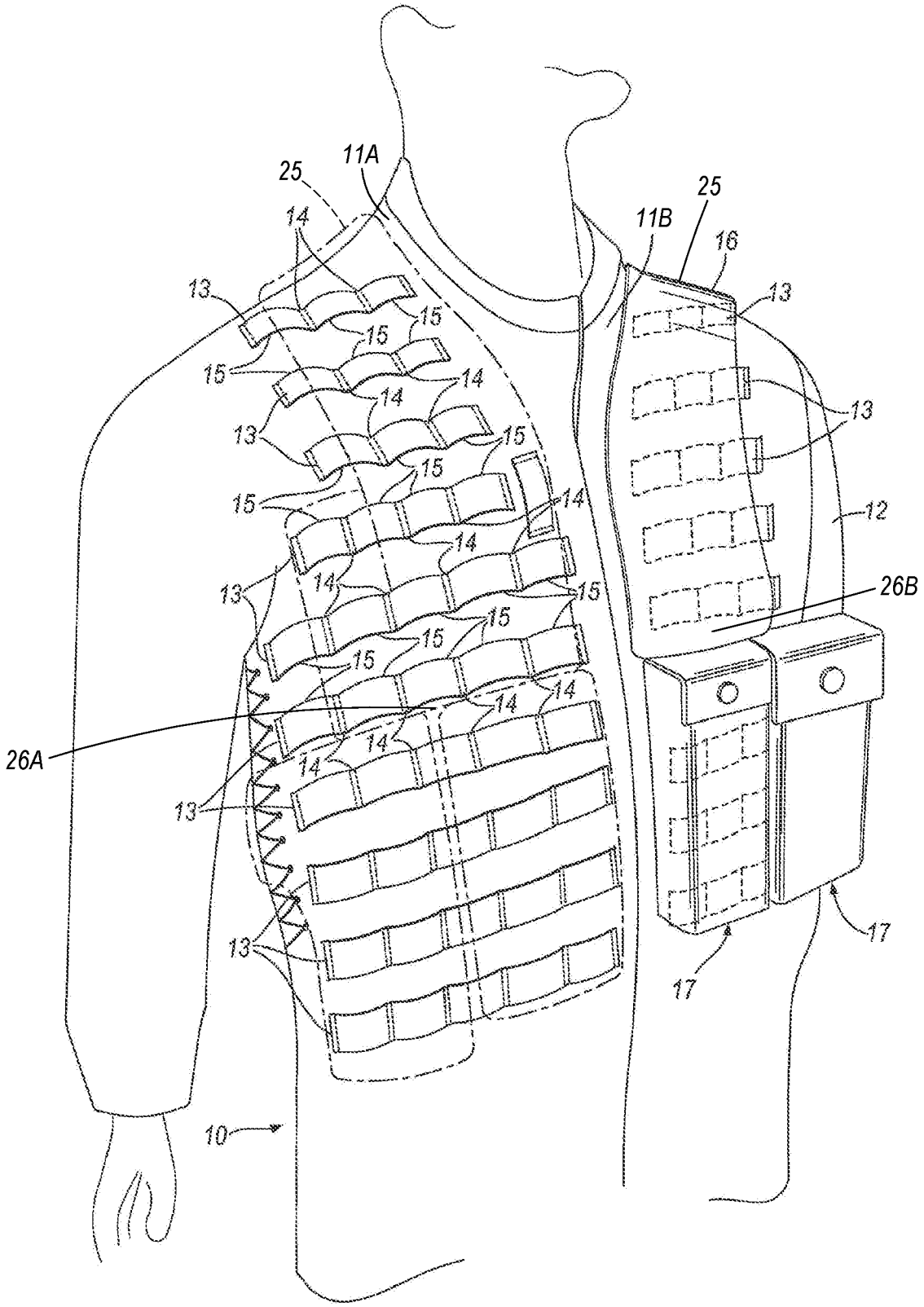
FIG. 1 is a schematic view of a load-carrying garment in the form of a military jacket including rows of webbing and with loads in the form of an inflatable lifejacket and two equipment packs attached to the garment.

Referring first to FIG. 1, a load-carrying garment 10 such as a military jacket has left and right front panels 11A, 11B overlying the chest of a wearer and meeting at the center of the chest, and arms 12 for receiving the arms of a wearer. The left and right front panels 11A, 11B are both provided with rows of webbing 13. The rows are parallel to but spaced from one another and, when the jacket is worn and the wearer upright, the rows are horizontal. The webbing may be arranged in accordance with the MOLLE (Modular Lightweight Load-carrying Equipment) specification (see, e.g. https://en.wikipedia.org/wiki/MOLLE). The MOLLE specification defines the current generation of load-bearing equipment and backpacks used by a number of NATO armed forces, especially the British Army and the United States Army.

The webbing may be a MACS system (Modular Attachment Carrier System), available from Survitec Group Ltd.

In an example embodiment, each row is formed by a single length of webbing 13 that is woven in known fashion from cotton or artificial fibres or a mixture of both and has a width of about 25 mm (although any suitable flexible material may be used). Each length of webbing 13 is stitched (or otherwise connected) to the associated panel 11A, 11B at its ends and at equidistant intervals between its ends along stitch lines 14, each stitch line 14 creating an attachment section. In one embodiment, the spacing between the stitch lines 14 is about 38 mm. Each webbing length 13 thus forms a succession of attached portions and unattached loops 15 along its length. The loops 15 formed by one row are vertically aligned with the loops of the next adjacent rows.

The function of the loops 15 is to allow the attachment to the garment of various loads. As seen in FIG. 1, these may include a packed inflatable lifejacket 16 and equipment packs 17.

Figure 2:
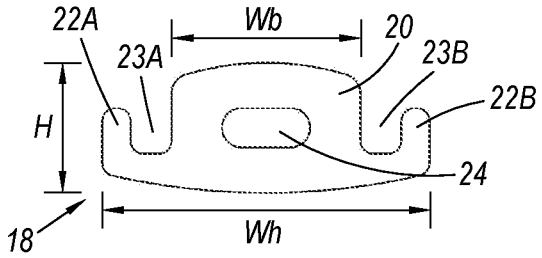
FIG. 2 shows front view of a hook arrangement according to an embodiment of the invention.

Referring next to FIG. 2, a hook part (or hook arrangement) indicated generally at 18 is used, in a manner to be described below, to attach loads such as the lifejacket 16 and the packs 17 to the jacket 10.

The hook part 18 is formed from a rigid flat elongate rectangular blank of metal, such as steel, although it should be appreciated that the hook part may be formed from any other suitable material (e.g. rigid plastics).

A first hook formation 22A extends from the left side (as shown in FIG. 2) of the generally rectangular main body portion 20 and provides a first recess 23A. A second hook formation 22B extends from the right side (as shown in FIG. 2) of the main body portion 20 and provides a second recess 23B. In a disclosed embodiment, the hook formations 22A and 22B are integrally formed with the main body portion 20. The main body portion 20 may be provided with a laterally extending slot 24.

In a disclosed embodiment, the hook part 18 is configured to co-operate with a MOLLE load-carrying garment 10 where each row of webbing that attached to a backing at attachment sections 14 spaced at approximately 38 mm intervals. The width Wh of the hook part 18 from the distal edges of the oppositely extending hook portions 22A, 22B is greater than 38 mm and the main body portion has a width Wb less than or equal to 38 mm. The arrangement is such that the attachment sections 14 fit into the recesses 23A, 23B to engage the load-carrying garment 10 in use. The hook part 18 has a height (measured in a direction perpendicular to the width) H that is less than or equal to 38 mm.

The use of the hook part 18 to connect a load to the garment 10 will now be described with the packed lifejacket 16 as the load.

Figure 7:
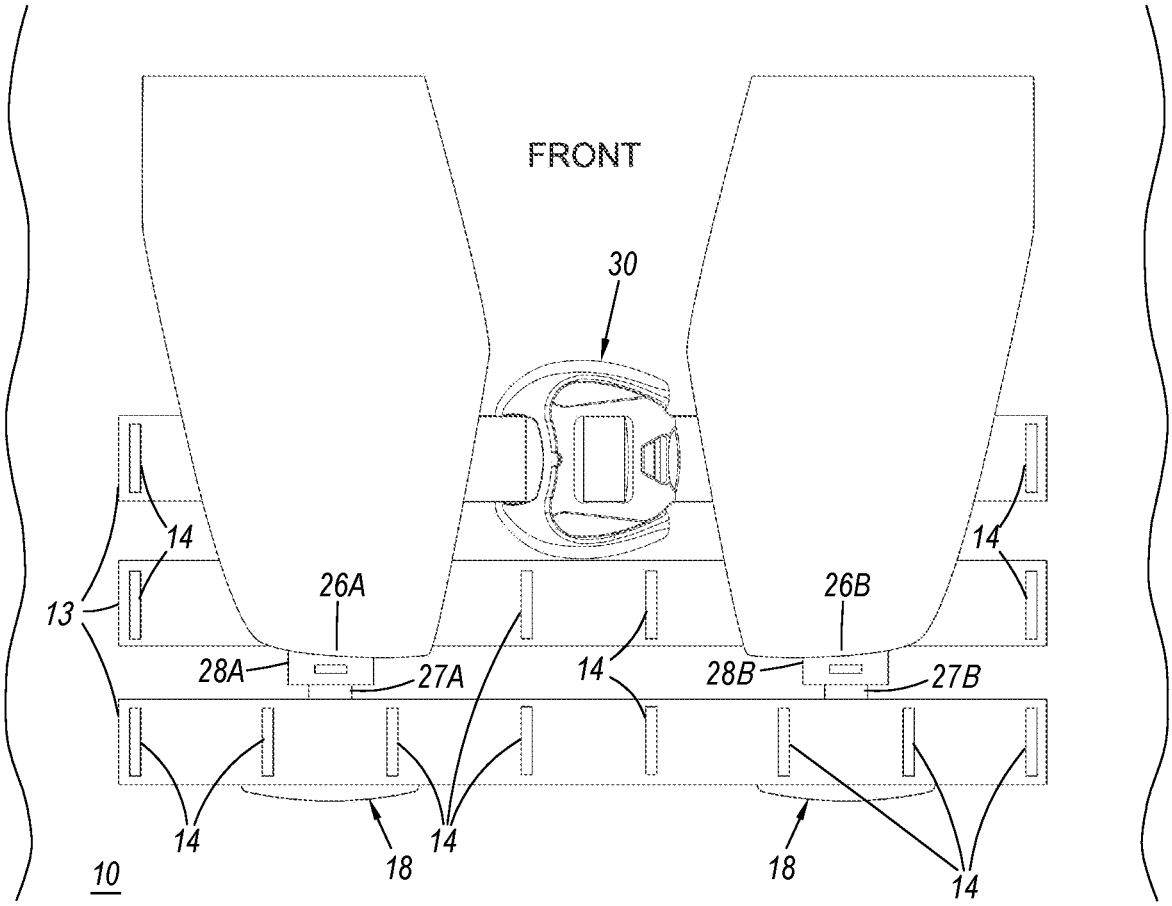
FIG. 7 shows a front view of the hook arrangement, loop and strap of FIG. 3, with the strap attached to a load and the hook arrangement attached to a webbing of a load-carrying garment.

The packed lifejacket 16 is generally U-shaped with the base 25 of the 'U' passing around a wearer's neck (as seen in FIG. 1) and the first and second free ends 26A, 26B extending over respective front panels 11*a*, 11*b* of the garment 10. Two hook parts 18 are connected to the lifejacket 16, one at each free end 26A, 26B. As best seen in FIG. 7, each end 26A, 26B of the lifejacket 16 is provided with a respective (e.g. fabric) loop 27A, 27B that extends through the slot 24 of the associated hook part 18 to connect the lifejacket 16 to the hook part. Each loop 27A, 27B may be connected to the lifejacket by a respective flexible strap 28A, 28B. In the disclosed embodiment, each hook part 18 is thus fixed to and hangs from the associated end 26A, 26B of the lifejacket 16. The connection allows the hook part 18 to swing freely on the lifejacket 16.

A buckle arrangement 30 may be provided near the free ends 26A, 26B of the lifejacket 16 to help secure the lifejacket 16 to the wearer.

Figure 3:
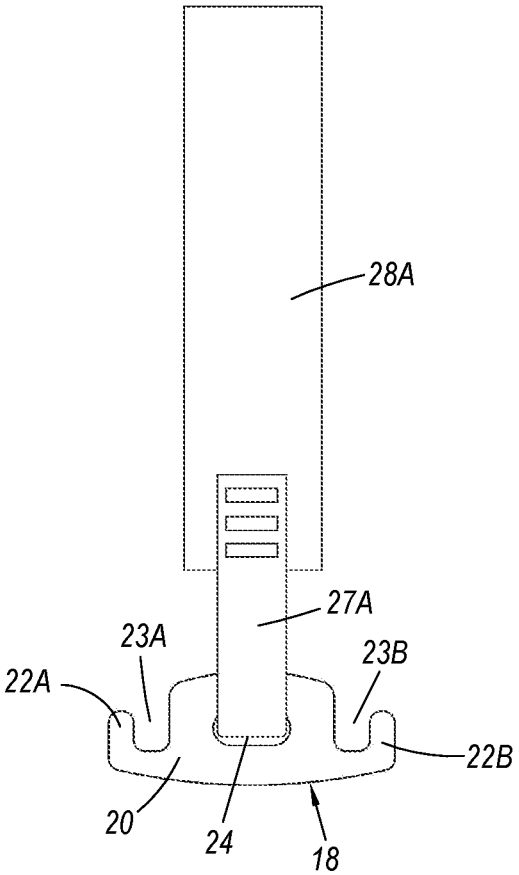
FIG. 3 shows front view of a hook arrangement attached to a loop and strap, for attachment to a load.
Figure 4:
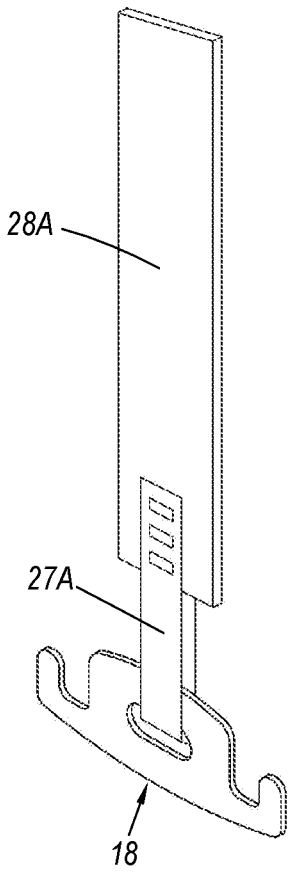
FIG. 4 shows perspective view of the hook arrangement, loop and strap of FIG. 3.
Figure 5:
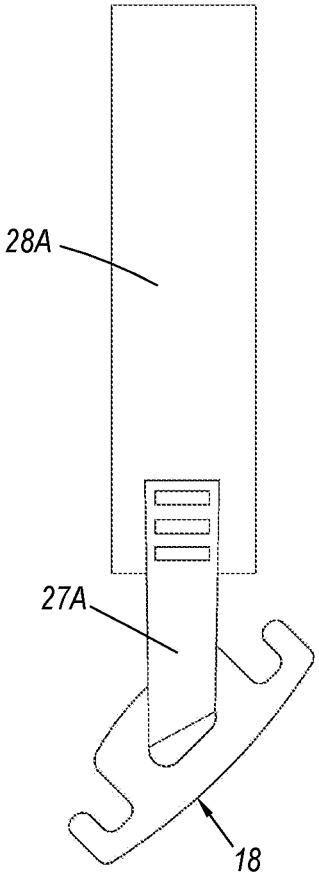
FIG. 5 shows front view of the hook arrangement, loop and strap of FIG. 3 with the clip partially rotated from a horizontal position.
Figure 6:
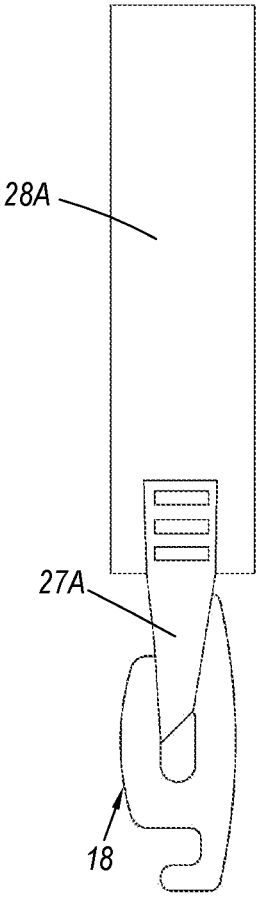
FIG. 6 shows front view of the hook arrangement, loop and strap of FIG. 3 with the clip rotated to a vertical position.

The hook part 18 has a horizontal orientation, as shown in FIGS. 3 and 4, where the top of the lateral slot 24 rests against the strap 27A, 27B. The hook part 18 is rotatable relative to the strap 27A, 27B, and the end 26A, 26B of the lifejacket 16, to an inclined orientation as shown in FIG. 5 and to a vertical orientation as shown in FIG. 6.

The terms "horizontal" and "vertical" used herein are for ease of understanding, and it should be appreciated that a strict or literal horizontal or vertical orientation is not necessary, but that the hook part is moveable between two orientations that are generally perpendicular to one another.

Figure 9:
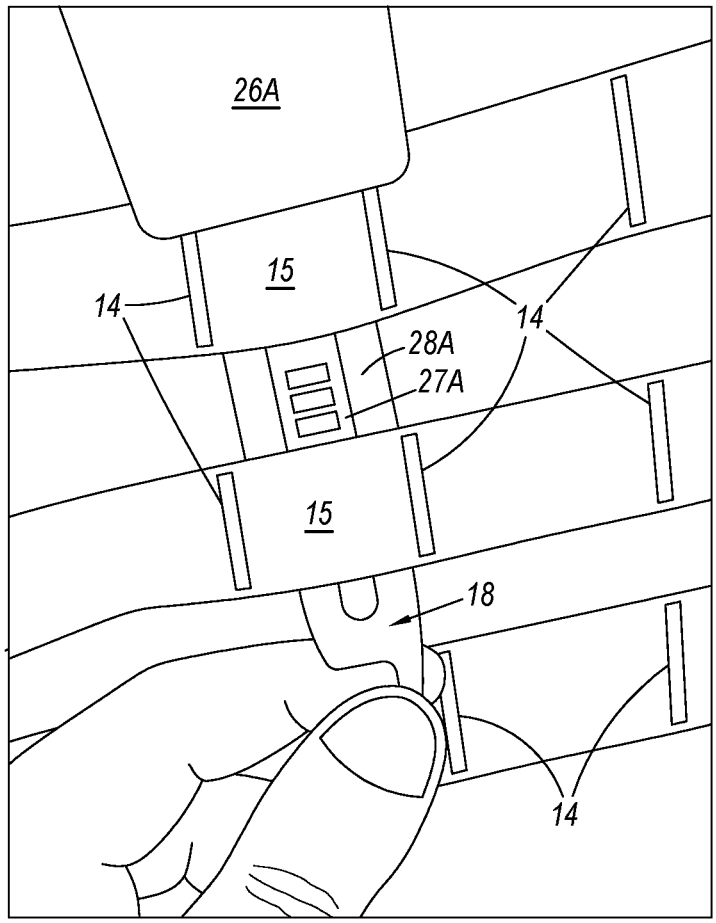
FIG. 9 shows a front view of the hook arrangement, loop and strap of FIG. 3, with the strap and the hook arrangement being passed through a gap in the webbing.

The lifejacket 16 is arranged around the neck of the wearer, as seen in FIG. 1. Each hook part 18 is then manually moved to the vertical orientation as shown in FIGS. 6 and 9 and passed through a loop 15 in a webbing row adjacent the end 26A, 26B of the lifejacket 16. The height H of the hook part 18 is such that it passes through the loops 15.

After passing through the loop 15, the hook part 18 then either naturally moves to the horizontal orientation or in manually moved to this orientation. Relative upward movement of the hook part 18 then causes adjacent attachment sections 14 to move into the recesses 23A, 23B. Once the base of the recesses 23A, 23B engages the attachment sections 14, further relative upward movement is not possible and the hook part 18 securely grips the webbing 13.

A portion of the loop 27A, 27B (and strap 28A, 28B, depending on the length of the loop 27A, 27B) also passes through the loop 15 formed by the webbing gripped by the hook part 18.

Figure 8:
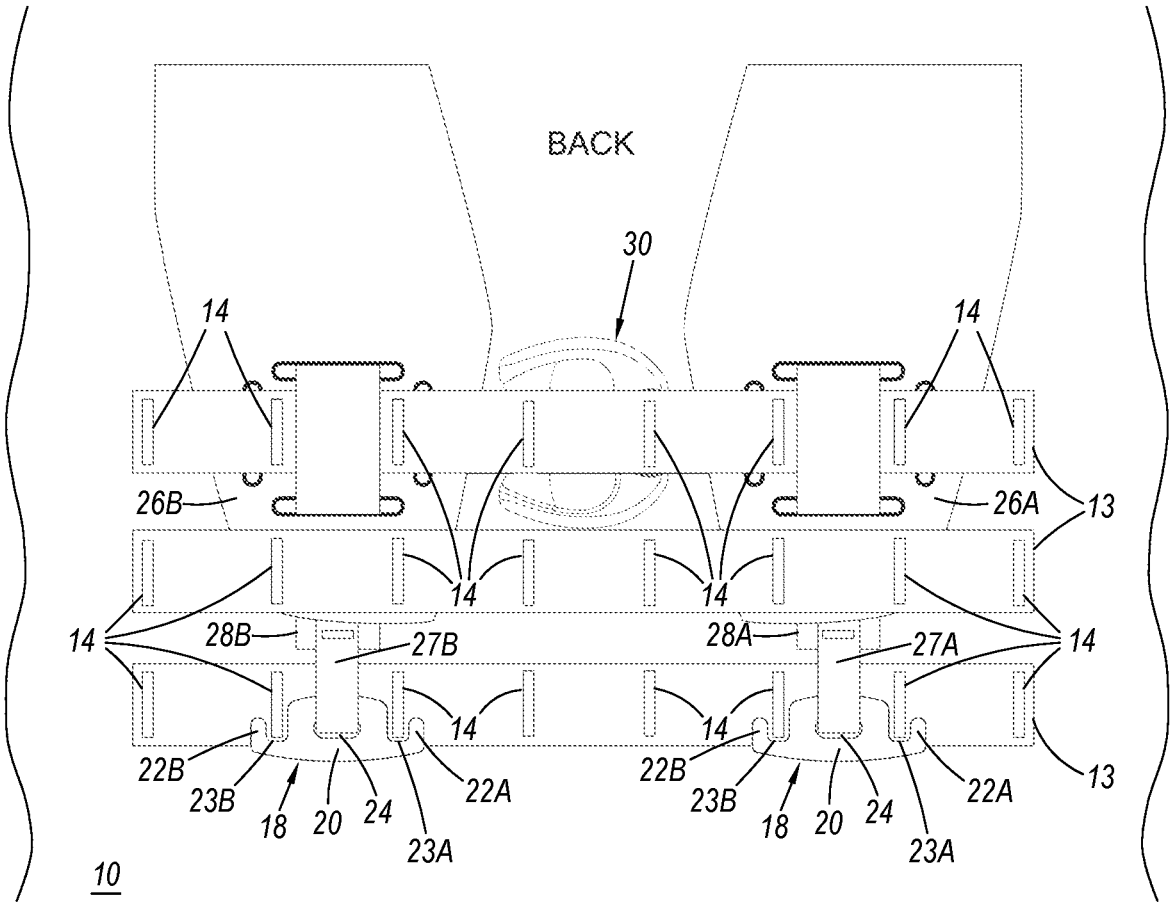
FIG. 8 shows a rear view of the hook arrangement, loop and strap of FIG. 3, with the strap attached to a load and the hook arrangement attached to a webbing of a load-carrying garment.

As shown in FIGS. 8 and 9, a portion of the strap 28A, 28B (and loop 27A, 27B, depending on the length of the loop 27A, 27B) may also be passed through a loop 15 of a webbing 13 above the webbing 13 gripped by the hook part 18.

In this way, as shown in FIGS. 7 and 8, the hook parts 18 are fixed firmly to the webbing 13 and thus the ends of the lifejacket 16 are firmly connected to the garment 10 to mount the lifejacket 16 on the garment 10.

In FIGS. 7 and 8 the hook part is shown with the hook portions 22A, 22B behind the webbing 13 (on the same side of the webbing 13 as the main body portion 20); however, the hook portions 22A, 22B may instead by located in front of the webbing 13 (on the opposite side of the webbing 13 as the main body portion 20).

An advantage of the arrangement described is that, when a loop 15 between two attachment sections 14 has a hook part 18 therein, that loop 15 may still be used for mounting other loads—unlike other prior arrangements.

The hook part 18 is easily disengaged manually by pulling it relatively downwards so that the adjacent attachment sections 14 to move out of the recesses 23A, 23B. The hook part can then be manually moved to the vertical orientation and can pass through the gap between the attachment sections 14.

The above description and the drawings refer to fixing hook parts 18 to webbing rows on a load-carrying garment on the front of the wearer's torso. A similar arrangement may be used to attach hook parts 18 to webbing rows on a load-carrying garment on the back of the wearer's torso, to thereby secure a load to the front and back of the wearer.

Other loads, such as the packs 17, can be attached to the garment using one or more hook parts 18 in a similar manner.

The hook part 18 could be formed of a strong plastics material.

The webbing rows 13 are shown and described as extending horizontally when the wearer is upright. While this is preferred, this need not be the case. The rows could have any desired orientation relative to the wearer.

The load may be any item that can usefully be carried by the wearer, such as pockets, holsters (e.g. for a weapon), communication equipment and first aid supplies.

In a disclosed embodiment, the hook part 18 is shown and described as connected to the lifejacket 16 by a loop 27A, 27B that extends through the slot 22 so that the clip is permanently fixed to the lifejacket 16 (or other load). It will be appreciated that the hook part 18 may be fixed in other ways by, for example, stitching. Alternatively, the hook part 18 may be removably attached to the lifejacket 16 (or other load) by, for example, a snap hook arrangement. Another attachment example is to attach the hook part 18 directly to the load with a rivet that passes through the load and an aperture in the hook part 18. These different arrangements still allow the hook part 18 to rotate relative to the load so that the hook can be moved to facilitate mounting to the load-carrying garment. In some of these arrangements the laterally extending slot 24 may be unnecessary and can be omitted. The shape of the main body portion 20 may be changed if the laterally extending slot 24 is omitted.

Although the invention has been described with reference to a MOLLE system, and the dimensions thereof, it should be understood that the invention may be used in other systems having different dimensions. In general, irrespective of the specific dimensions, the width of the hook part 18 should be greater than the space between adjacent attachment sections 14 and the height of the hook part 18 should be less than or equal to the space between adjacent attachment sections 14, so that, when in a first orientation, the hook part 18 hooks under the adjacent attachment sections 14, and, when in a second orientation, the hook part 18 can pass through the space between adjacent attachment sections 14.

The invention claimed is:

1. A load-carrying system comprising:

a garment having generally parallel spaced rows of webbing, each webbing being attached to the garment at spaced intervals so that each webbing has alternate attached and unattached sections along its length with the unattached sections in generally vertical alignment, and a hook arrangement configured to be flexibly attached to a load, wherein the hook arrangement comprises a main body portion from which two hook portions extend at opposite sides thereof, the hook portions each defining a recess for engaging the attached sections of the webbing in use, and wherein the hook arrangement has a width from the distal edges of the oppositely extending hook portions that is greater than an interval between two adjacent attached sections of the webbing and a height that is less than or equal to the interval between said two adjacent attached sections of the webbing, the hook arrangement being rotatable between a generally horizontal orientation, where it cannot pass through the interval between said two adjacent attached sections of the webbing, and a generally vertical orientation, where it can pass through the interval between said two adjacent attached sections of the webbing, the arrangement being such that the hook arrangement may pass through the interval between said two adjacent attached sections of the webbing in the generally vertical orientation whereafter the hook arrangement may be moved to the generally horizontal configuration so that the said two adjacent attached sections of the webbing fit into the recesses.

2. The load-carrying system of claim 1, wherein the garment comprises body armor.

3. The load-carrying system of claim 1, wherein the hook arrangement is configured such that a further load may be attached to a same portion of webbing between the adjacent attached sections of the webbing while the hook arrangement is in place.

4. The load-carrying system of claim 1, in combination with the load attached to a same portion of webbing between the adjacent attached sections of the webbing while the hook arrangement is in place.

5. The load-carrying system of claim 4, including a further load.

6. The load-carrying system of claim 4, wherein the load comprises a life preserver unit such as a lifejacket.

7. A method of attaching a load to a load-carrying garment, wherein:

the load-carrying garment is formed with generally parallel spaced rows of webbing, each webbing being attached to the garment at spaced intervals so that each webbing has alternate attached and unattached sections along its length with the unattached sections in generally vertical alignment, a hook arrangement is flexibly attached to the load, wherein the hook arrangement comprises a main body portion from which two hook portions extend at opposite sides thereof, the hook portions each defining a recess for engaging the attached sections of the webbing, and passing the hook arrangement in a generally vertical orientation through the interval between said two adjacent attached sections of the webbing, and moving the hook arrangement to a generally horizontal orientation so that the said two adjacent attached sections of the webbing fit into the recesses to engage the load-carrying garment.

8. The method of claim 7, further comprising attaching a further load to a portion of the webbing prior to attaching the said load to the same portion of webbing, the hook arrangement being passed behind a part attaching the further load to the portion of the webbing.

* * * * *